United States Patent [19]

Sievers

[11] 4,077,659

[45] Mar. 7, 1978

[54] GOLF BALL TEEING DEVICE

[76] Inventor: Paul Sievers, 986 Fenworth Blvd., Franklin Square, N.Y. 11010

[21] Appl. No.: 723,812

[22] Filed: Sep. 16, 1976

[51] Int. Cl.[2] ..... A63B 47/02

[52] U.S. Cl. ..... 294/19 A

[58] Field of Search ..... 294/19 R, 19 A, 33, 294/99 R, 55.5; 273/32 R, 32 D, 32 F, 33, 162 R, 162 C, 162 E, 162 F

[56] References Cited

U.S. PATENT DOCUMENTS

| | | | |
|---|---|---|---|
| 2,448,644 | 9/1948 | Williams | 294/19 A |
| 2,738,214 | 3/1956 | Zimmers | 294/19 A |
| 3,434,753 | 3/1969 | DeCroes | 294/55.5 X |
| 3,520,569 | 7/1970 | Anderson | 294/19 A |
| 3,889,946 | 6/1975 | Setecka | 273/33 |
| 3,922,027 | 11/1975 | Nesselt | 294/19 A |

FOREIGN PATENT DOCUMENTS

| | | | |
|---|---|---|---|
| 2,791 of | 1902 | United Kingdom | 294/19 A |

*Primary Examiner*—Johnny D. Cherry

[57] ABSTRACT

Resilient arcuate fingers attached to a handle partially encircle and support a golf ball. The golf ball is then placed on a golf tee without bending over and the teeing device is slid out from under the ball. An alternative embodiment retrieves golf balls from water hazards and the like.

4 Claims, 5 Drawing Figures

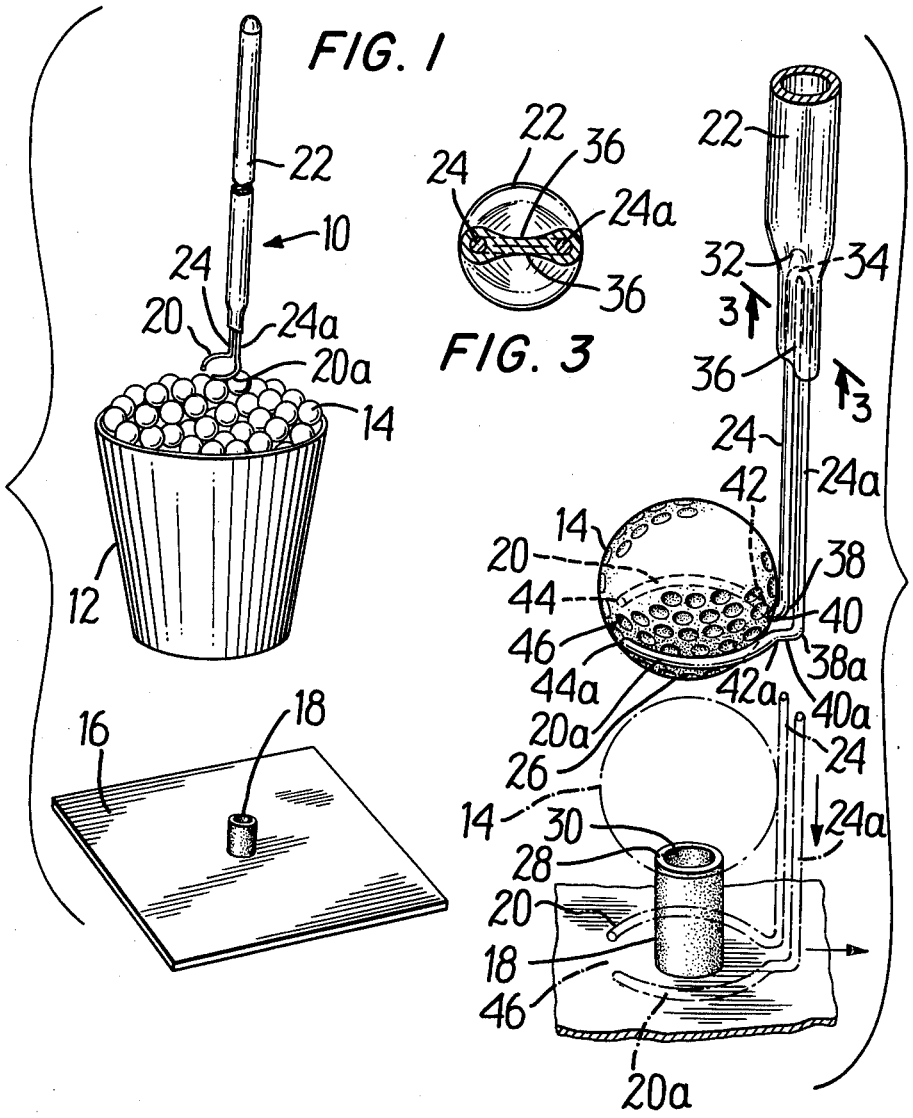
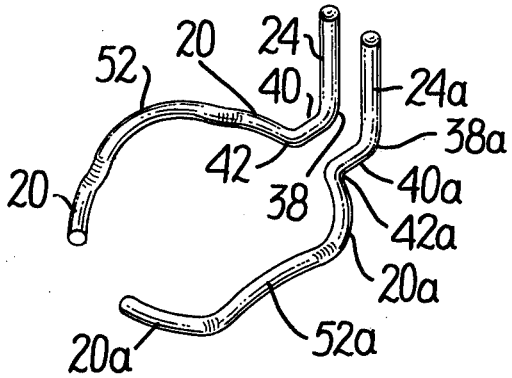
FIG. 5
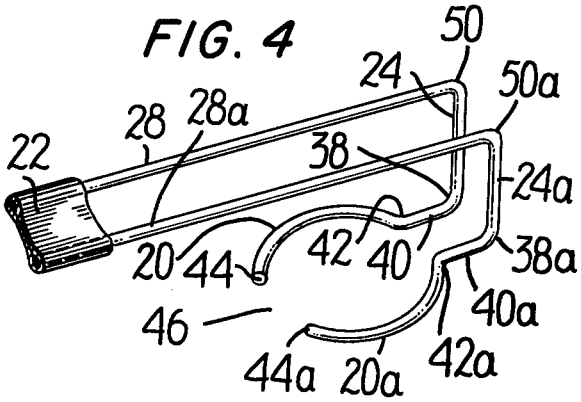

GOLF BALL TEEING DEVICE

BACKGROUND OF THE INVENTION

Most golfers, in order to polish driving skills, repetitively practice driving golf balls from a fixed tee. Golf driving ranges are available in which, for a fee, the golfer is given a container holding a number of golf balls and access to the tee and range. He then tees up each ball on the tee; and drives it down the range.

It has been observed that the repetitive stooping over to pick up each golf ball from the container and to place it on the tee is tiring and the resulting muscle soreness detracts from the joy of practice.

Some golf driving ranges offer fixed devices which tee up the golf balls one at a time. Fixed devices of this sort are expensive as evidenced by the higher fees charged by golf driving ranges offering them. The prior art does not disclose a portable device adapted to teeing up a golf ball without stooping over.

Golfers also suffer balls which come to rest in locations where they can be seen but not reached in water, through fences and under low objects. The prior art contains nets and scoops on extensible handles for reaching such balls. Nets and scoops fail to positively secure the ball once engaged and often allow the ball to again fall. The well known perversity of inanimate objects practically guarantees that the dropped ball will come to rest in a new location which is unseeable and/or unreachable even with the aid of a device for picking it up.

SUMMARY OF THE INVENTION

The instant invention teaches a golf ball teeing device with two arcuate spaced-apart fingers attached to and directed generally at right angles from a handle. The fingers are spaced apart leaving an aperture between them smaller in cross section than the diameter of the great circle of a golf ball. The fingers are each connected to a resilient subshaft. The two resilient subshafts are connected to the shaft of a substantially rigid handle.

To pick up a golf ball, the arcuate fingers are suspended over the ball with the center of the aperture aligned over the center of the ball. The arcuate fingers are then pressed down over the ball. Due to their resilience and the resilience of the subshafts, the arcuate fingers are spread apart to accommodate the maximum diameter of the golf ball, then resume their former spacing below the waist of the golf ball. When the handle and attached arcuate fingers are then raised, the golf ball is supported and carried by the arcuate fingers. Alternatively, the arcuate fingers may be inserted below the waist of the golf ball without pressing them down over its maximum diameter.

The golf ball supported by the arcuate fingers is suspended over, then lowered onto a golf tee. The golf tee engages the golf ball in its lower hemisphere through the opening in the spaced-apart arcuate fingers. As the arcuate fingers are lowered still further, the golf ball becomes independently supported atop the tee. The arcuate fingers of the teeing device are then slid out from under the ball while the shaft of the tee passes through the space between the arcuate fingers.

In an alternative embodiment of the device useful for picking up golf balls from water, through fences and the like, the lower part of the sub-shafts are given a reverse bend which brings the arcuate fingers into the vicinity of and spaced away from the upper part of the sub-shafts. When a ball is supported by pressing the arcuate fingers over it, as previously described, it remains firmly captured between the arcuate fingers and the upper part of the sub-shafts. To increase the reach of the device, a telescoping handle may be employed.

BRIEF DESCRIPTION OF THE DRAWINGS

FIG. 1 shows a pictorial view of the golf ball teeing device in its working location.

FIG. 2 shows a closeup view of the golf ball teeing device holding a golf ball above a tee.

FIG. 3 is a cross section along 3—3 in FIG. 2.

FIG. 4 shows a balanced embodiment of the invention.

FIG. 5 shows an embodiment with arcuate fingers having a reverse bend.

DETAILED DESCRIPTION OF THE PREFERRED EMBODIMENT

Referring to FIG. 1, the golf ball teeing device 10 is shown suspended over a bucket 12 containing a plurality of golf balls 14. The bucket 12 is shown resting near a mat 16 containing a tee 18. Arcuate fingers **20, 20*a* are attached to the end of a shaft 22 by subshafts 24, 24*a*. The spacing between the arcuate fingers 20, 20*a* is smaller than the great circle diameter of a golf ball 14. The subshafts 24, 24*a* are preferably of springable resilient material such as steel or semi-rigid plastic. The arcuate fingers 20, 20*a* are pressed down over one of the balls 14 in the bucket 12. Due to the resilience in the subshafts 24, 24*a*, the arcuate fingers 20, 20*a* are enabled to move apart to pass the great circle diameter of the golf ball 14, then move together below the golf ball 14. When the teeing device 10 is raised, the arcuate fingers 20, 20*a* support the golf ball 14 and raise it with them. It is not necessary to use care in positioning the arcuate fingers 20, 20*a* over a particular golf ball 14 in the bucket 12. Instead, it has been found that merely stabbing the end of the teeing device 10 into the bucket 12 is usually effective to capture one of the golf balls 14** therein.

When a golf ball 14 is supported on the teeing device 10, it is transferred over the tee 18 and lowered thereon.

As more clearly shown in FIG. 2, the arcuate fingers **20, 20*a* support the golf ball 14 leaving a lower portion 26 of the golf ball 14** exposed in the space between them.

The tee 18 has an opening or depression in its top end adapted to supporting the golf ball 14. The example tee 18 shown, often seen in commercial golf driving ranges, consists of a vertical rubber cylinder 28 having an axial hole 30. The golf ball 14 is placed on the top of the rubber cylinder 28 and rests centered in the axial hole 30.

The shaft 22 is preferably a hollow metal cylinder and the ends of the subshafts **24, 24*a* are preferably inserted into the cylinder and secured there by depressing the shaft 22 upon them as at 32. The subshafts 24, 24*a* may optionally be joined together, as by the hairpin loop 34 shown dashed in FIG. 2. When the shaft 22 is flattened upon the hairpin loop 34, the metal may be pressed into an inward groove 36 between the subshafts 24, 24*a* to prevent their withdrawal. Further penetration of the shaft 22 may be prevented by ridges or external bends in the subshafts (not shown). FIG. 3 shows the manner of flattening and grooving the shaft 22 about the subshafts 24, 24*a*. Other forms of shaft 22**, such as solid metal, plastic or wood, and other methods of attachment such as adhesives, nails, rivets, screws or clamps may be substituted without departing from the spirit and scope of the inventive concept.

In the embodiment shown in FIG. 2, the subshafts 24, 24*a* extend parallel to the axis of the shaft 22. The subshafts 24, 24*a* are joined at bends 38, 38*a* of approximately 90° to connecting pieces 40, 40*a*. The connecting pieces 40, 40*a* also shown in the embodiment in FIG. 4 are joined to the arcuate fingers 20, 20*a* at bends 42, 42*a* of less than 90°. The arcuate fingers 20, 20*a* are shaped to curve about an axis substantially parallel to the shaft 22. The arcuate fingers terminate at 44, 44*a* leaving a gap 46 of at least ¼ inch between them. The gap 46 is useful to allow the passage of the tee 18 when withdrawing the teeing device 10 after the ball 14 is balanced on the tee 18.

The embodiment in FIG. 2 has the axis of the shaft 22 laterally displaced from the center of the ball 14 resulting in a slight imbalance. A balanced embodiment may be made which has the axis of the shaft 22 passing through the center of the ball by making additional bends in the subshafts which displace the shaft 22 axis to coincide with the center of the ball.

The alternate embodiment shown in FIG. 5 has lateral arcuate bends 52, 52*a*. The lateral arcuate bends 52, 52*a* resist the tendency of a ball 14 to roll out from under the arcuate fingers 20, 20*a* while attempting to capture it with the teeing device 10. The lateral arcuate bends 52, 52*a* are inclined upward and outward from the axis of the arcuate fingers 20, 20*a* at an angle which allows them to rest against the surface of the golf ball 14.

FIG. 4 shows an embodiment for picking up a golf ball at a distance. In this embodiment, bends 50 and 50*a* of approximately 90° in the lower part of the subshafts 24, 24*a* brings the arcuate fingers 20, 20*a* into spaced-apart relationship with the upper parts 28, 28*a* of the subshafts. The spacing between the upper parts 28, 28*a* and the arcuate fingers 20, 20*a* is such that, once a golf ball is socketed in the arcuate fingers, the upper parts 28, 28*a* prevent it falling out. The reach of the device may be improved by making the shaft 22 telescoping.

It will be understood that the claims are intended to cover all changes and modifications of the preferred embodiments of the invention, herein chosen for the purpose of illustration which do not constitute departures from the spirit and scope of the invention.

What is claimed is:

1. A golf ball teeing device comprising:

a. a shaft;

b. first and second resilient subshafts;

c. said subshafts extending parallel to the axis of said shaft;

d. means for attaching said first and second resilient subshafts to one end of said shaft, said means comprising:

i. a connected hairpin bend at the upper end of said resilient subshafts;

ii. an axial hollow in said shaft;

iii. said hairpin bend being fitted into said axial hollow iv. flattened portions of said shaft being over at least the region occupied by said hairpin bend e. first and second arcuate fingers attached to said first and second subshafts, said arcuate fingers terminating in ends;

f. said first and second arcuate fingers being curved in opposing arcs having concave sides facing each other;

g. said arcuate fingers being in a plane substantially normal to the axis of said shaft;

h. each said arcuate finger containing a lateral arcuate continuously curved bend, said bend being directed upward from said plane and being directed outwards from the arc of that particular arcuate finger;

i. the opening between said arcuate fingers being smaller than the great circle diameter of a golf ball whereby a golf ball can be supported thereon;

j. the axis of said shaft passing outside the center of said golf ball when said golf ball is supported by said arcuate fingers; and k. the ends of said arcuate fingers leaving a gap of at least ¼ inch therebetween.

2. The teeing device of claim 1 wherein the subshafts are formed of semi-rigid plastic.

3. The teeing device of claim 1 wherein the subshafts are formed of steel.

4. The teeing device of claim 1 wherein the shaft is a hollow metal cylinder.

* * * * *